US006472929B2

(12) United States Patent
Kobayashi et al.

(10) Patent No.: US 6,472,929 B2
(45) Date of Patent: Oct. 29, 2002

(54) SEMICONDUCTOR DEVICE

(75) Inventors: Isamu Kobayashi, Kasugai (JP); Yoshiharu Kato, Kasugai (JP); Takahiro Yokoyama, Kasugai (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/927,371

(22) Filed: Aug. 13, 2001

(65) Prior Publication Data

US 2002/0043669 A1 Apr. 18, 2002

(30) Foreign Application Priority Data

Sep. 8, 2000 (JP) ..... 2000-273812

(51) Int. Cl.[7] ..... G05F 1/10
(52) U.S. Cl. ..... 327/540
(58) Field of Search ..... 326/80, 81; 327/319, 327/333, 530, 534, 535, 537, 538, 540, 541, 543, 564, 565, 566

(56) References Cited

U.S. PATENT DOCUMENTS 6,052,012 A * 4/2000 Camerlo ..... 327/292
6,157,251 A * 12/2000 Camerlo ..... 327/292

FOREIGN PATENT DOCUMENTS

JP A-2000-011649 1/2000
JP A-2000-124797 4/2000

* cited by examiner

*Primary Examiner*—Jeffrey Zweizig
(74) *Attorney, Agent, or Firm*—Arent Fox Kintner Plotkin & Kahn, PLLC

(57) ABSTRACT

A semiconductor device which is capable of shutting off the influence of noise introduced into a reference voltage while preventing an increase in die size. The semiconductor device including a reference potential generator, first and second filter, and first and second input circuit. The reference potential generator generates a reference potential in accordance with a first power supply. The first filter is connected to the first power supply and filters the reference potential to generate a first filtered reference potential. The second filter is connected to a second power supply and filters the reference potential to generate a second filtered reference potential. The first input circuit is connected to the first power supply and receives the first filtered reference potential to generate a first predetermined voltage. The second input circuit is connected to the second power supply and receives the second filtered reference potential to generate a second predetermined voltage.

9 Claims, 8 Drawing Sheets

SEMICONDUCTOR DEVICE

BACKGROUND OF THE INVENTION

The present invention relates to a semiconductor device comprising an input circuit which operates in accordance with a reference potential, and more particularly, to countermeasures to noise introduced into a reference potential supplied to a plurality of input circuits.

Latest semiconductor memory devices receive power from various external power supplies due to the tendency toward an increased number of bits and larger scale of die size. For example, a driver circuit for I/O pads is supplied with power from external dedicated power supplies VccQ, VssQ, while general peripheral function circuits within a device are supplied with power from external general power supplies Vcc, Vss. Among the peripheral function circuits, a circuit for converting the level of a small voltage supplied from an external input pin, and a sense amplifier for discriminating a small potential difference are vulnerable to external noise, so that they are separated from circuits which consume a large amount of power, such as a delay locked loop (DLL) circuit. In this event, wires associated with the power supplies Vcc, Vss for the sense amplifier are separated from pads for the DLL circuit.

FIG. 1 is a schematic circuit diagram illustrating a sense amplifier 100 of a semiconductor integrated circuit which is described in Japanese Unexamined Patent Publication No. 2000-11649. The sense amplifier 100 is supplied with an internal supply voltage Vint to a node N1 via a low pass filter 1. The node N1 is connected to an inverter circuit 2, so that a voltage changing rate at the node N1 is adjusted in response to a changing rate of a reference voltage Vref supplied to the inverter circuit 2.

When the internal supply voltage Vint rises, potentials at nodes N2, N3 once rise, and a potential difference is generated between the nodes N2 and N3 based on the internal supply voltage Vint. A latch circuit 3 performs a latch operation in accordance with the potential difference. This configuration prevents the latch operation from starting with unstable voltage levels at the nodes N2, N3, so that a normal latch signal is output from the latch circuit 3.

After the internal supply voltage Vint has risen, the internal supply voltage Vint may be supplied to other circuits. In this event, a consumed current temporarily increases to cause sudden fluctuations in the level of the internal supply voltage Vint. However, high frequency noise caused by the fluctuations in the internal supply voltage Vint is removed by the low pass filter 1. Therefore, the latch circuit 3 is prevented from erroneous operations due to fluctuations in the internal supply voltage Vint.

In the sense amplifier 100, the internal supply voltage Vint is supplied to the inverter circuit 2 via the low pass filter 1, while the reference voltage Vref is supplied to the inverter circuit 2 without intervention of a low pass filter. In this event, for avoiding the influence of noise in the reference voltage Vref, it is necessary to commonly provide a power supply Vss of a voltage generator circuit for generating the internal supply voltage Vint, a power supply Vss of a reference voltage generator circuit for generating the reference voltage Vref, and a power supply Vss of the sense amplifier. This requirement imposes a large constraint on designing of layouts of the respective generator circuits, sense amplifier and power supply wiring, and results in a larger die size of the device.

FIGS. 2 through 5 are schematic circuit diagrams illustrating an internal power supply circuit 200 for a semiconductor integrated circuit described in Japanese Unexamined Patent Publication No. 2000-124797.

The internal power supply circuit 200 includes a boost power generator circuit 4, two control voltage generator circuits 5*a*, 5*b*, and four power supply circuits 6*a* to 6*d*.

The boost power generator circuit 4 receives power from a power supply Vcc2 and a power supply Vss2, and performs a pumping operation in accordance with an oscillating signal supplied from an oscillator 7 and having a predetermined frequency to generate a boosted voltage Vpp1. The boosted voltage Vpp1 is supplied to the first and second control voltage generator circuits 5*a*, 5*b* which have the same configuration.

The first control voltage generator circuit 5*a* generates a first control voltage Vg1 which is higher than the reference voltage Vref by a predetermined voltage based on the boosted voltage Vpp1 and the power supply Vss1. The second control voltage generator circuit 5*b* generates a second control voltage Vg2 which is higher than the reference voltage Vref by a predetermined voltage based on the boosted voltage Vpp1 and the power supply Vss2.

The first control voltage Vg1 is supplied to the power supply circuit 6*b* for a DLL circuit (see FIG. 3). The power supply circuit 6*b* for a DLL circuit receives power from a power supply Vcc1 and the power supply Vss1, and generates a predetermined first internal supply voltage ViiD in accordance with the first control voltage Vg1.

The second control voltage Vg2 is supplied to the power supply circuit 6*a* or to the power supply circuit 6*d* illustrated in FIG. 5. Each of the power supply circuits 6*a*, 6*d* receives power from the power supply Vcc2 and the power supply Vss2, and generates a second predetermined internal supply voltage ViiS in accordance with the second control voltage Vg2.

The power supply circuit 6*c* illustrated in FIG. 4 generates a supply voltage Viin for other circuits in the DLL circuit. The power supply circuit 6*c* receives power from the power supplies Vcc1, Vss1 or from the power supplies Vcc2, Vss2, and generates the supply voltage Viin in accordance with the first or second control voltage Vg1, Vg2.

Each of the power supply circuits 6*b* to 6*d* has a low pass filter 8 which absorbs noise introduced into each of the control voltages Vg1, Vg2.

The internal power supply circuit 200 requires a plurality of control voltage generator circuits 5*a*, 5*b* for supplying corresponding control voltages to the plurality of power supply circuits 6*a*, 6*b*, 6*c*, 6*d* connected to different power supplies. Therefore, a device which requires multiple power supplies for its operations must have multiple control voltage generator circuits laid out therein, thereby causing an increase in the die size of the device.

SUMMARY OF THE INVENTION

It is an object of the present invention to provide a semiconductor device which is capable of shutting off the influence of noise introduced into a reference voltage while preventing an increase in die size.

In one aspect of the present invention, there is provided a semiconductor device including a reference potential generator circuit for generating a reference potential in accordance with a first power supply, a first filter connected to the reference potential generator circuit and the first power supply for filtering the reference potential to generate a first filtered reference potential, a second filter connected to the reference potential generator circuit and a second power supply for filtering the reference potential to generate a second filtered reference potential, a first input circuit connected to the first filter and the first power supply for receiving the first filtered reference potential to generate a first predetermined voltage, and a second input circuit connected to the second filter and the second power supply for receiving the second filtered reference potential to generate a second predetermined voltage.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
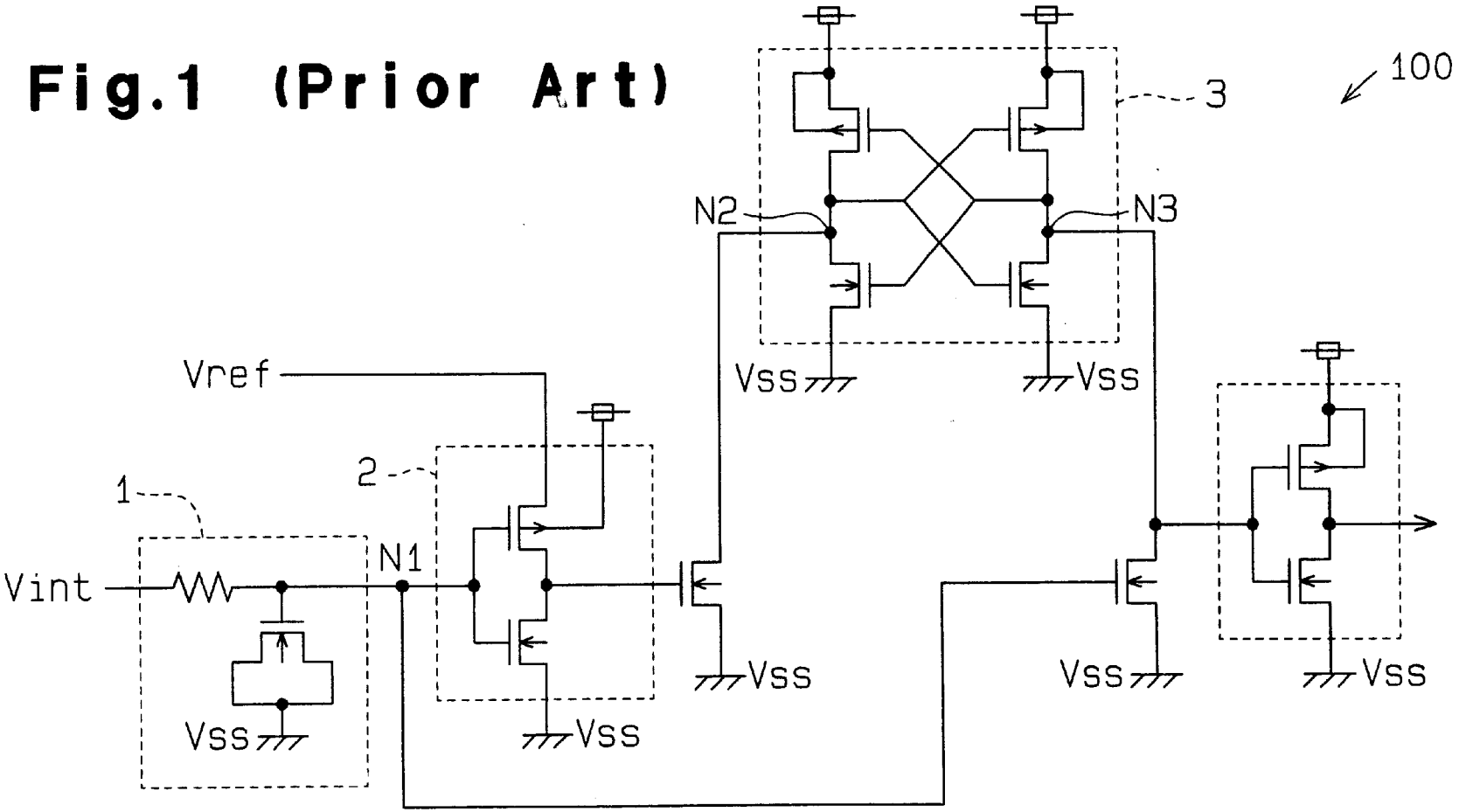
Fig.1 (Prior Art)
FIG. 1 is a schematic circuit diagram illustrating a sense amplifier according to a first prior art example.
Figure 2:
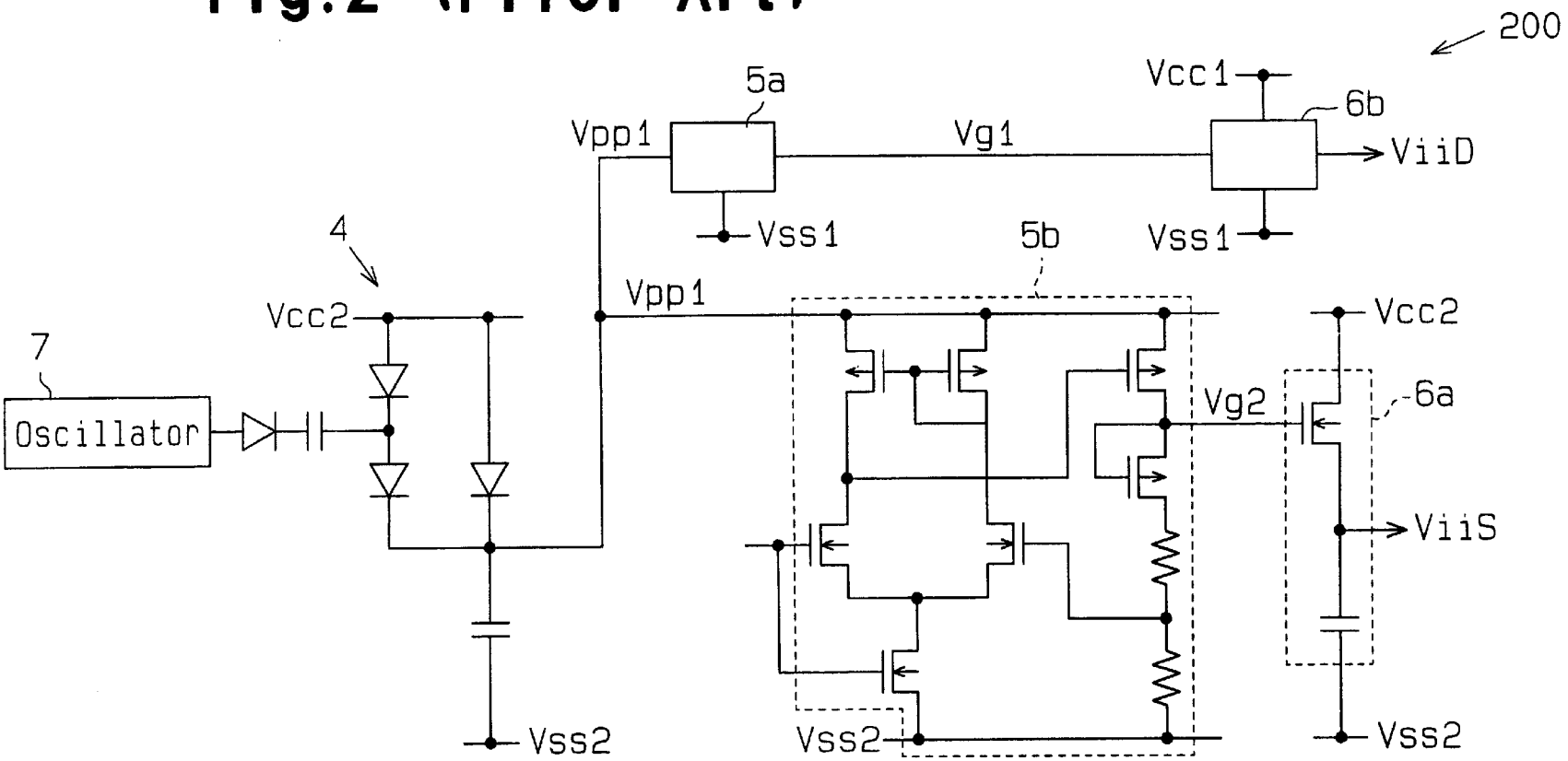
Fig.2 (Prior Art)
FIG. 2 is a schematic circuit diagram illustrating an internal power supply circuit according to a second prior art example.
Figure 3:
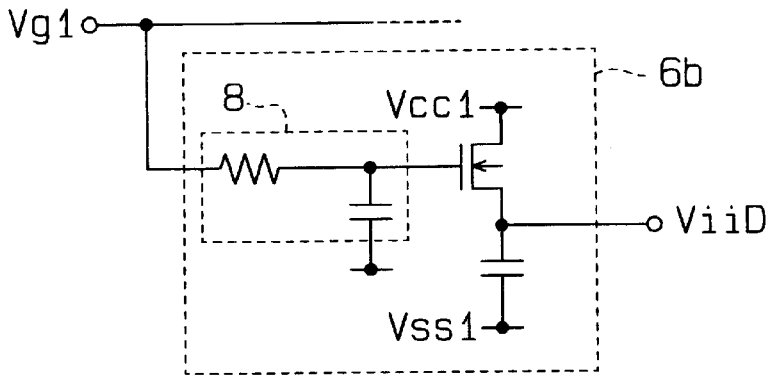
Fig.3 (Prior Art)
FIG. 3 is a schematic circuit diagram illustrating a power supply circuit of the internal power supply circuit of FIG. 2.
Figure 4:
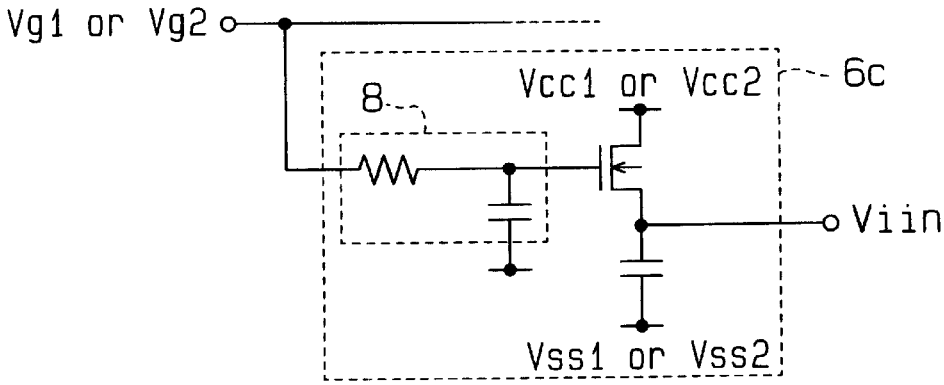
Fig.4 (Prior Art)
FIG. 4 is a schematic circuit diagram illustrating a power supply circuit of the internal power supply circuit of FIG. 2.
Figure 5:
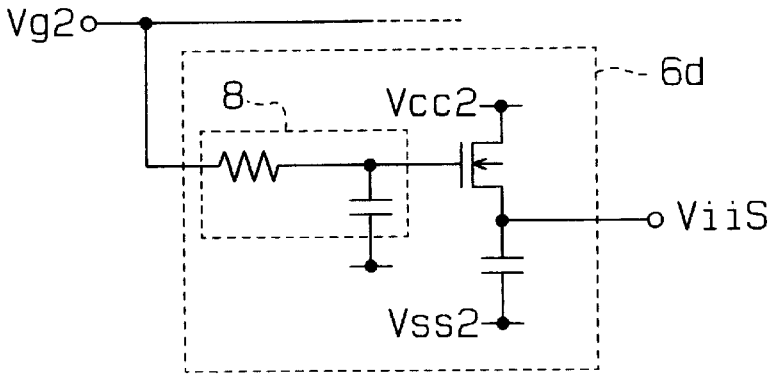
Fig.5 (Prior Art)
FIG. 5 is a schematic circuit diagram illustrating a power supply circuit of the internal power supply circuit of FIG. 2.

In the drawings, like numerals are used for like elements throughout.

Figure 6:
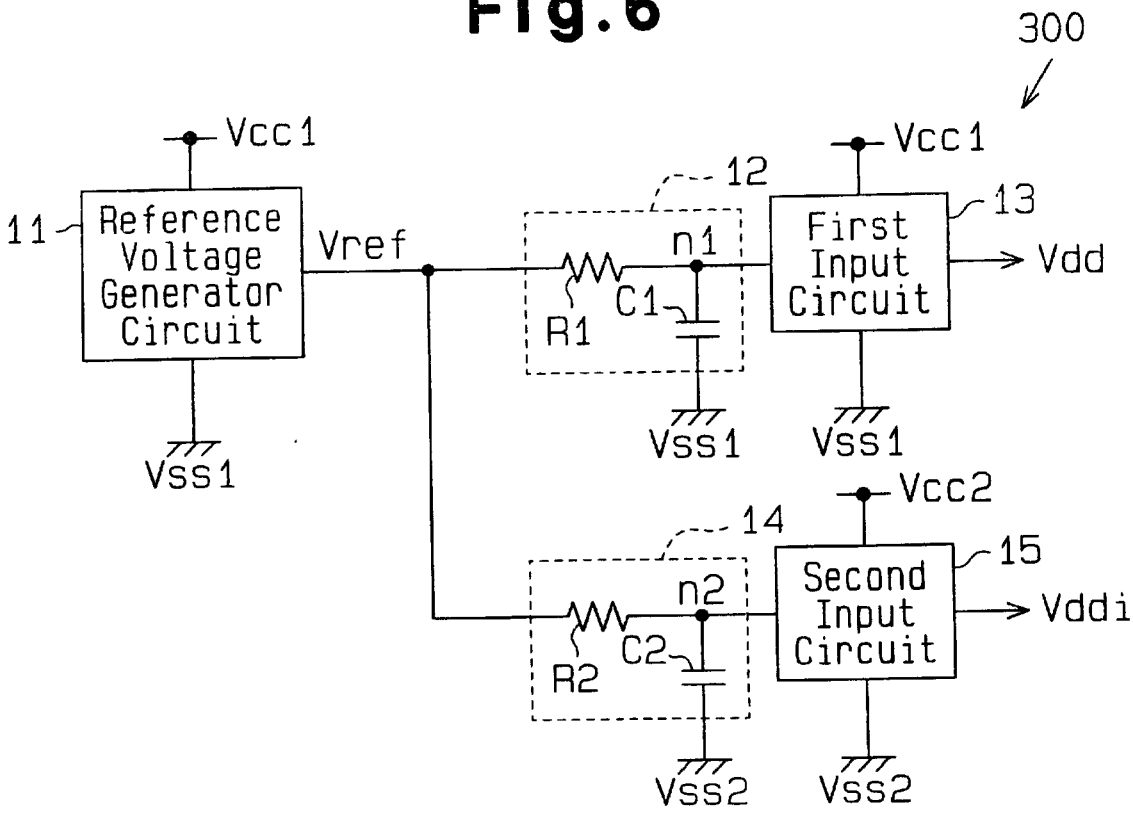
FIG. 6 is a schematic block diagram illustrating a semiconductor device according to one embodiment of the present invention.

FIG. 6 is a block diagram generally illustrating a semiconductor device 300 according to one embodiment of the present invention. The semiconductor device 300 includes a reference potential generator circuit 11, first and second low pass filters 12, 14, and first and second input circuits 13, 15. Each of the circuits 11 to 15 is formed on the same semiconductor substrate, and functions as an input circuit unit of the semiconductor device 300. The first input circuit 13 is included in a first functional circuit of the semiconductor device 300, while the second input circuit 15 is included in a second functional circuit.

The reference potential generator circuit 11 receives power from a high potential power supply Vcc1 and a low potential power supply Vss1, and generates a reference potential Vref. The reference potential Vref is supplied to the first input circuit 13 via the first low pass filter 12 as well as to the second input circuit 15 via the second low pass filter 14.

The first low pass filter 12 includes a resistor RI and a capacitor C1. The capacitor C1 has a first terminal connected to a node n1 which is an input terminal of the first input circuit 13, and a second terminal connected to the power supply Vss1. The first input circuit 13 receives power from the high potential power supply Vcc1 and low potential power supply Vss1.

The second low pass filter 14 includes a resistor R2 and a capacitor C2. The capacitor C2 has a first terminal connected to a node n2 which is an input terminal of the second input circuit 15, and a second terminal connected to a low potential power supply Vss2. The second input circuit 15 receives power from a high potential power supply Vcc2 and the low potential power supply Vss2. The low potential power supply Vss2 is laid out such that it is completely separated from the low potential power supply Vss1 within the chip of the semiconductor device. However, the low potential power supply Vss1 and low potential power supply Vss2 are at the same ground level. In this way, this embodiment employs a different system of low potential power supply for each input circuit.

Figure 7:
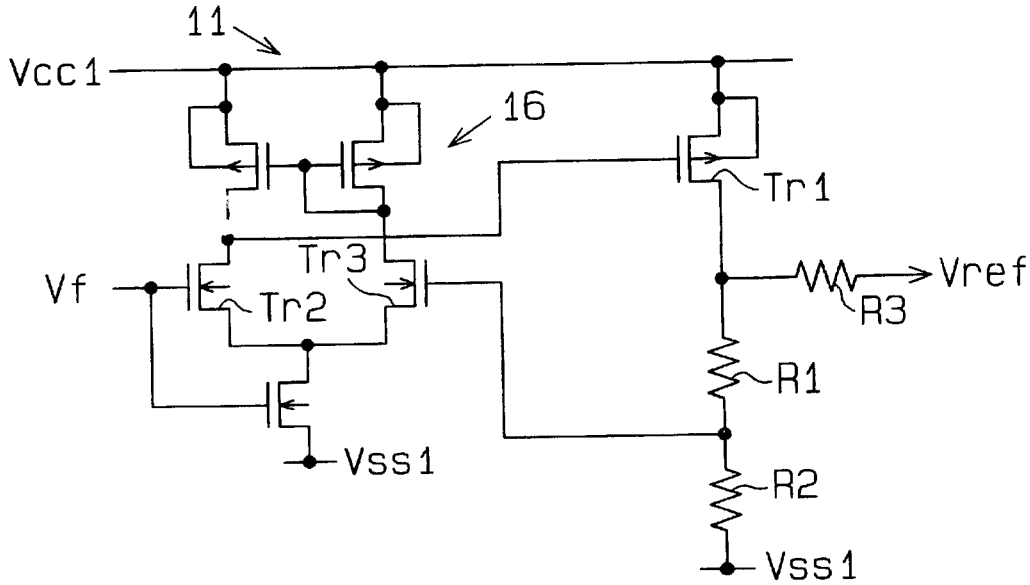
FIG. 7 is a schematic circuit diagram illustrating a reference potential generator circuit of the semiconductor device of FIG. 6.

As illustrated in FIG. 7, the reference potential generator circuit 11 is a known circuit which includes a differential circuit 16, an output P-channel MOS transistor Tr1, and resistors R1 to R3.

When the differential circuit 16 is supplied with a constant voltage Vf at a gate of an N-channel MOS transistor Tr2, the differential circuit 16 operates such that a potential at a gate of an N-channel MOS transistor Tr3 matches the constant voltage Vf. With this operation, the predetermined reference potential Vref is generated.

Figure 8:
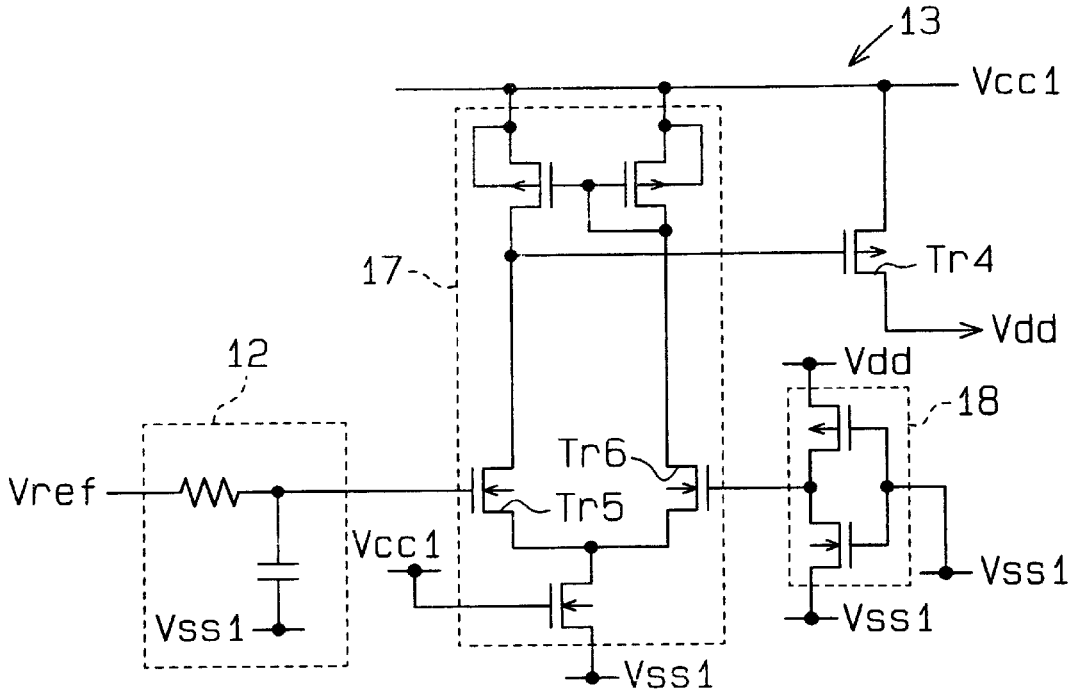
FIG. 8 is a schematic circuit diagram illustrating a first input circuit of the semiconductor device of FIG. 6.

As illustrated in FIG. 8, the first input circuit 13 generates a first predetermined internal supply voltage Vdd in accordance with the reference potential Vref. The first input circuit 13 includes a differential circuit 17 which receives power from the high potential power supply Vcc1 and low potential power supply Vss1, an inverter circuit 18 connected to the differential circuit 17, and an output P-channel MOS transistor Tr4 connected to the differential circuit 17. The inverter circuit 18 has an input terminal connected to the low potential power supply Vss1, and receives power from the low potential power supply Vss1 and the internal power supply Vdd generated by the first input circuit 13.

The filtered reference potential Vref output from the first low pass filter 12 is supplied to a gate of an N-channel MOS transistor Tr5 in the differential circuit 17, while an inverted output signal of the inverter circuit 18 is supplied to a gate of an N-channel MOS transistor Tr6.

Figure 9:
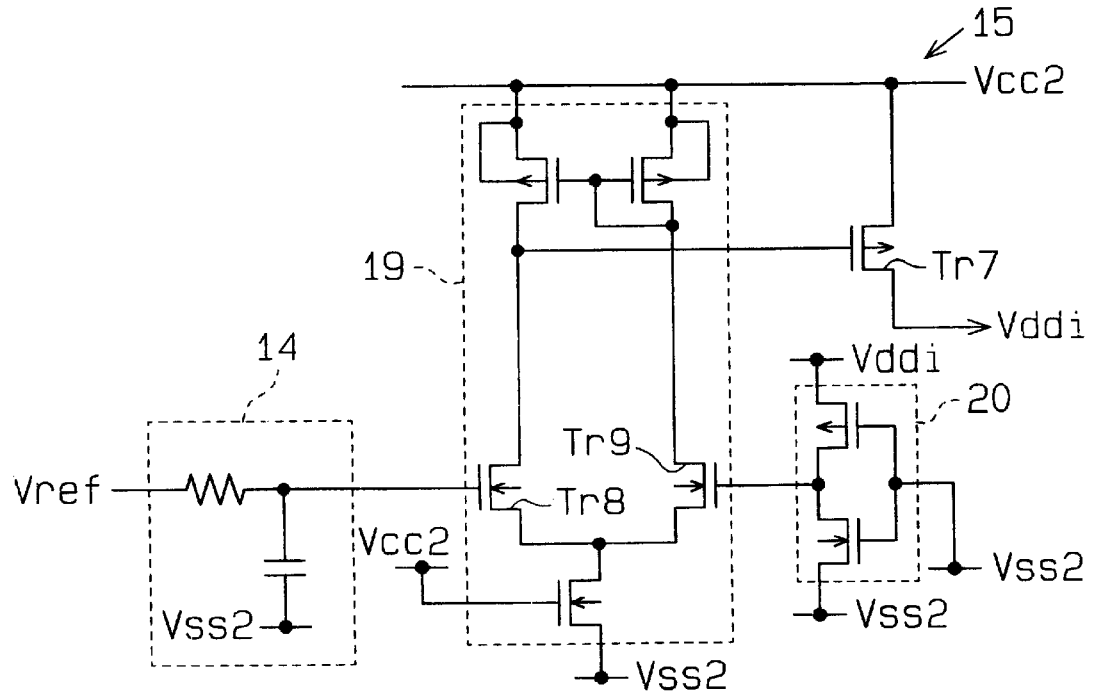
FIG. 9 is a schematic circuit diagram illustrating a second input circuit of the semiconductor device of FIG. 6.

As illustrated in FIG. 9, the second input circuit 15 generates a second predetermined internal supply voltage Vddi in accordance with the reference potential Vref. The second input circuit 15 includes a differential circuit 19 which receives power from the high potential power supply Vcc2 and the low potential power supply Vss2, an inverter circuit 20 connected to the differential circuit 19, and an output P-channel MOS transistor Tr7 connected to the differential circuit 19. The inverter circuit 20 has an input terminal connected to the low potential power supply Vss2, and receives power from the low potential power supply Vss2 and the internal power supply Vddi generated by the second input circuit 15.

The filtered reference voltage Vref output from the second low pass filter 14 is supplied to a gate of an N-channel MOS transistor Tr8 of the differential circuit 19, while an inverted output signal from the inverter circuit 20 is supplied to a gate of an N-channel MOS transistor Tr9.

Next, the operation of the semiconductor device 200 will be described.

The reference potential generator circuit 11, first low pass filter 12 and first input circuit 13 are supplied with power from the common high potential and low potential power supplies Vcc1, Vss1. Therefore, when noise occurring in the low potential power supply Vss1 introduces into the reference potential Vref, the low potential power supply Vss1 of the first input circuit 13 also includes noise in phase with the reference potential Vref. However, since a threshold of the first input circuit 13 does not vary in relation to fluctuations in the reference potential Vref due to the noise, the first input circuit 13 generates the stable internal supply voltage Vdd.

When the reference potential Vref fluctuates due to noise in the low potential power supply Vss1, the fluctuations are absorbed by the second low pass filter 14. Therefore, the second input circuit 15 is supplied with the stable reference potential Vref.

When noise occurs in the low potential power supply Vss2, the first input circuit 13 is not at all affected by the noise since the input circuit 13 is not associated with the low potential power supply Vss2. Also, when the low potential power supply Vss2 fluctuates, a potential at the node n2 varies in phase with the fluctuations in the low potential power supply Vss2 due to capacitive coupling of the capacitor C2 of the second low pass filter 14. Thus, a threshold of the second input circuit 15 does not vary in relation to fluctuations of the output signal of the second low pass filter 14, allowing the second input circuit 13 to generate the stable internal supply voltage Vddi.

Figure 10:
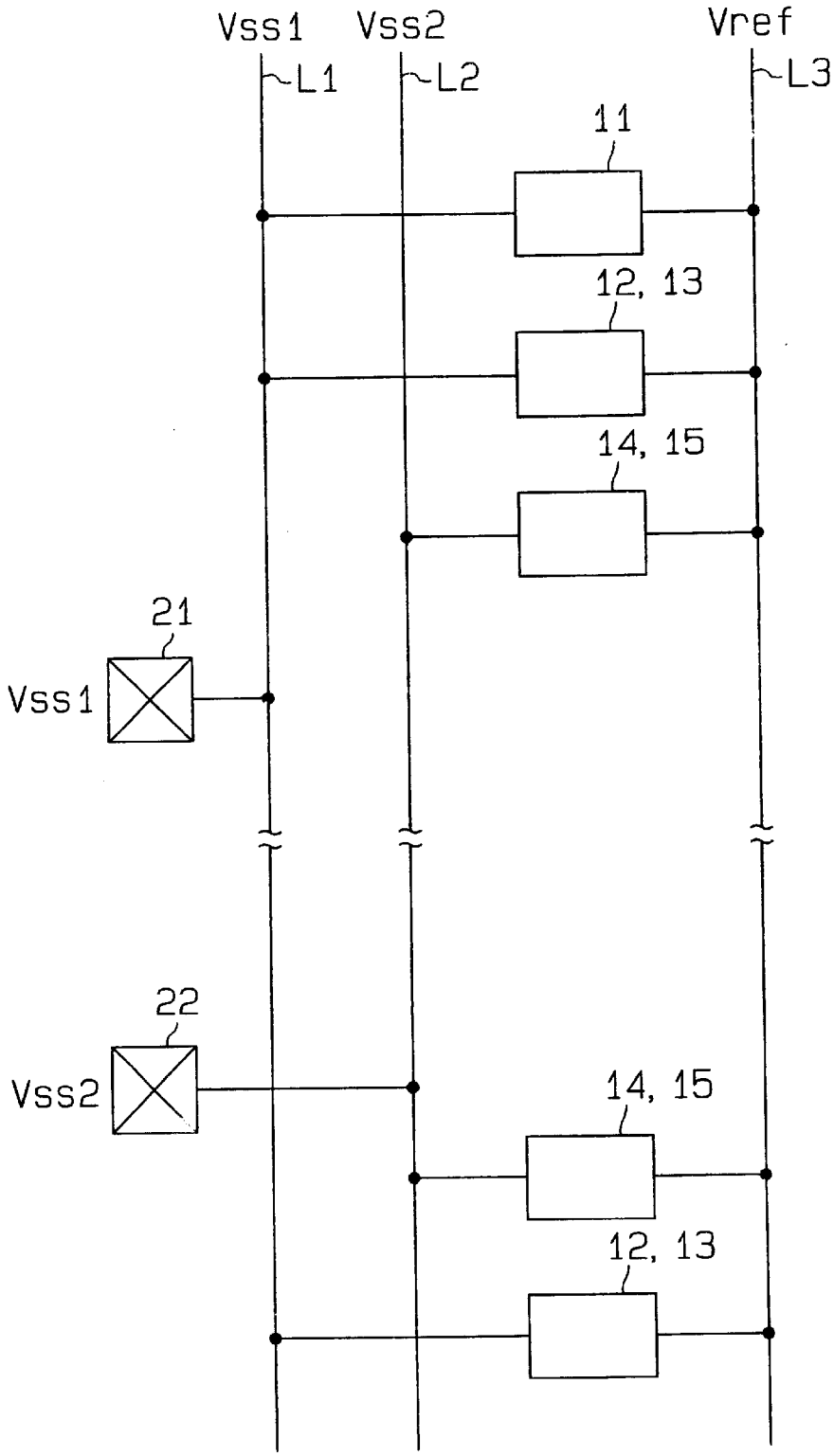
FIG. 10 is an explanatory diagram illustrating a layout of the semiconductor device of FIG. 6.

Next, the layout of the semiconductor device 300 will be described with reference to FIG. 10. The reference potential generator circuit 11, first low pass filter 12 and first input circuit 13 are supplied with the voltage of the low potential power supply Vss1 from a pad 21 through a wire L1. The first and second low pass filters 12, 14 in turn are supplied with the reference potential Vref through a wire L3.

The second low pass filter 14 and second input circuit 15 are supplied with the voltage of the low potential power supply Vss2 from a pad 22 through a wire L2.

With the layout as described, the first and second input circuits 13, 15 are supplied with the reference potential Vref from the common reference potential generator circuit 11 respectively through the first and second low pass filters 12, 14.

The semiconductor device 300 according to the present invention provides the following advantages.

(1) Even if noise occurring in the low potential power supply Vss1 introduces into the reference potential ref, the first input circuit 13 stably generates the internal supply voltage Vdd.

(2) Even if noise occurs in the reference potential Vref, the noise is absorbed by the second low pass filter 14, so that the second input circuit 15 is supplied with the stable reference potential Vref. Consequently, the second input circuit 13 stably generates the internal supply voltage Vddi.

(3) Even if noise occurs in the low potential power supply Vss2, the potential at the node n2 varies in phase with fluctuations in the low potential power supply Vss2 due to the capacitive coupling of the capacitor C2 of the second low pass filter 14. Since the threshold of the second input circuit 15 does not vary in relation to the fluctuations of the voltage of the output signal from the second low pass filter 14 (the potential at the node n2), the second input circuit 13 stably generates the internal power supply Vddi.

(4) The common reference potential Vref is supplied to each of the input circuits 13, 15 from the reference potential generator circuit 11. This eliminates the need for a plurality of circuits for generating reference voltages, and the need for laying out a plurality of wires for supplying a plurality of reference potentials to a plurality of input circuits, resulting in a reduction in the die size of the device.

(5) The reference potential Vref is supplied to each of the input circuits 13, 15 from the reference potential generator circuit 11. This eliminates the need for providing a plurality of reference potential generator circuits corresponding to multiple power supplies, resulting in a reduction in the die size of the device.

It should be apparent to those skilled in the art that the present invention may be embodied in many other specific forms without departing from the spirit or scope of the invention. Particularly, it should be understood that the invention may be embodied in the following forms.

Figure 11:
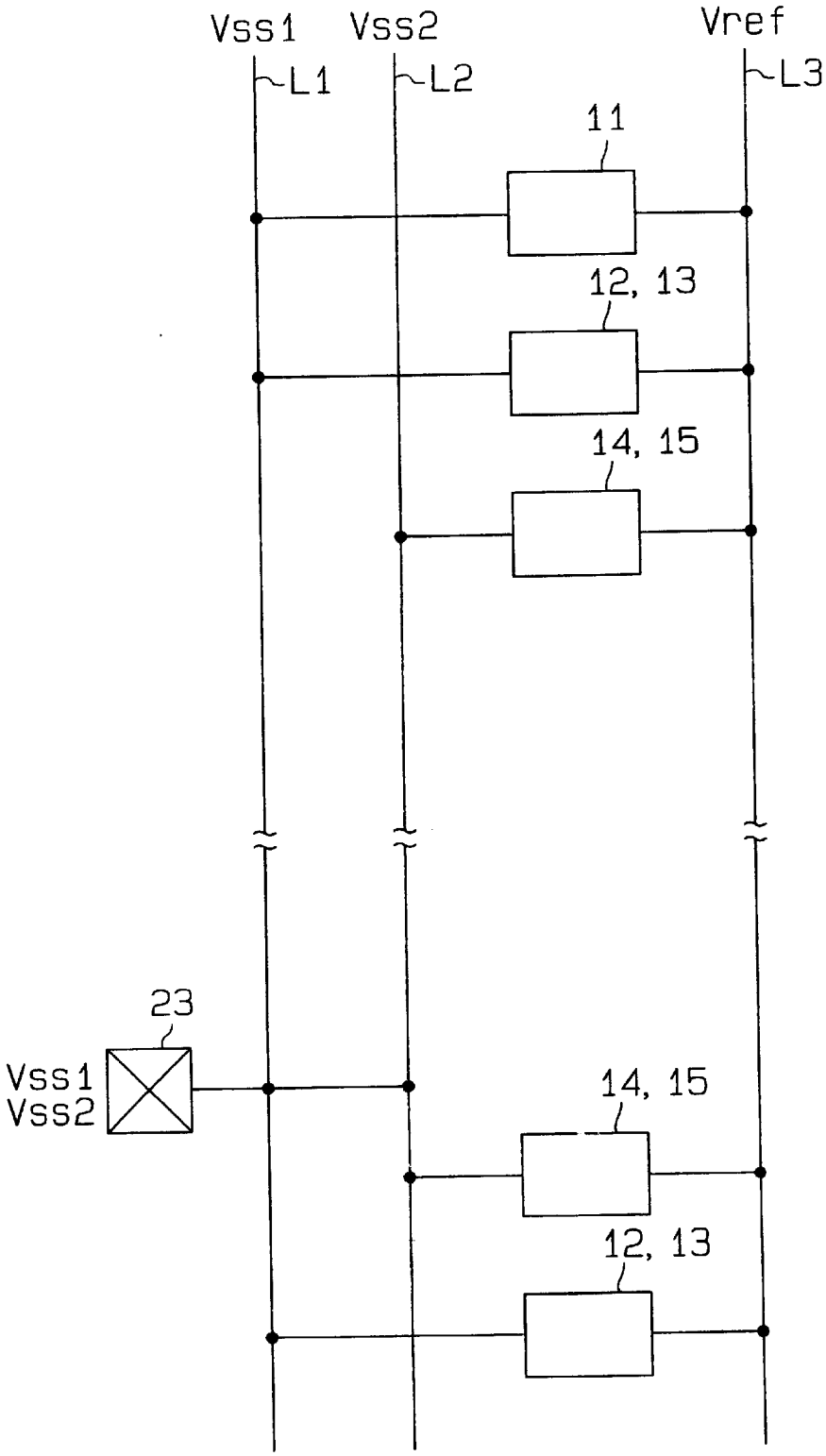
FIG. 11 is an explanatory diagram illustrating another layout of the semiconductor device of FIG. 6.

(a) As illustrated in FIG. 11, the low potential power supply Vss1 and low potential power supply Vss2 may be supplied to the reference potential generator circuit 11, first and second low pass filters 12, 14, and first and second input circuits 13, 15 through a common pad 23 and a plurality of power supply wires L1, L2 independent of each other.

(b) In the first input circuit 13, the transistor Tr6 of the differential circuit 17 may be directly supplied with the internal supply voltage Vdd. Alternatively, the transistor Tr6 may be supplied with a divided potential which may be generated by resistively dividing the potential difference between the internal supply voltage Vdd and the voltage of the low potential power supply Vss1.

(c) In the second input circuit 15, the transistor Tr9 of the differential circuit 19 may be directly supplied with the internal supply voltage Vddi. Alternatively, the transistor Tr9 may be supplied with a divided potential which may be generated by resistively dividing the potential difference between the internal supply voltage Vddi and the voltage of the low potential power supply Vss2.

Figure 12:
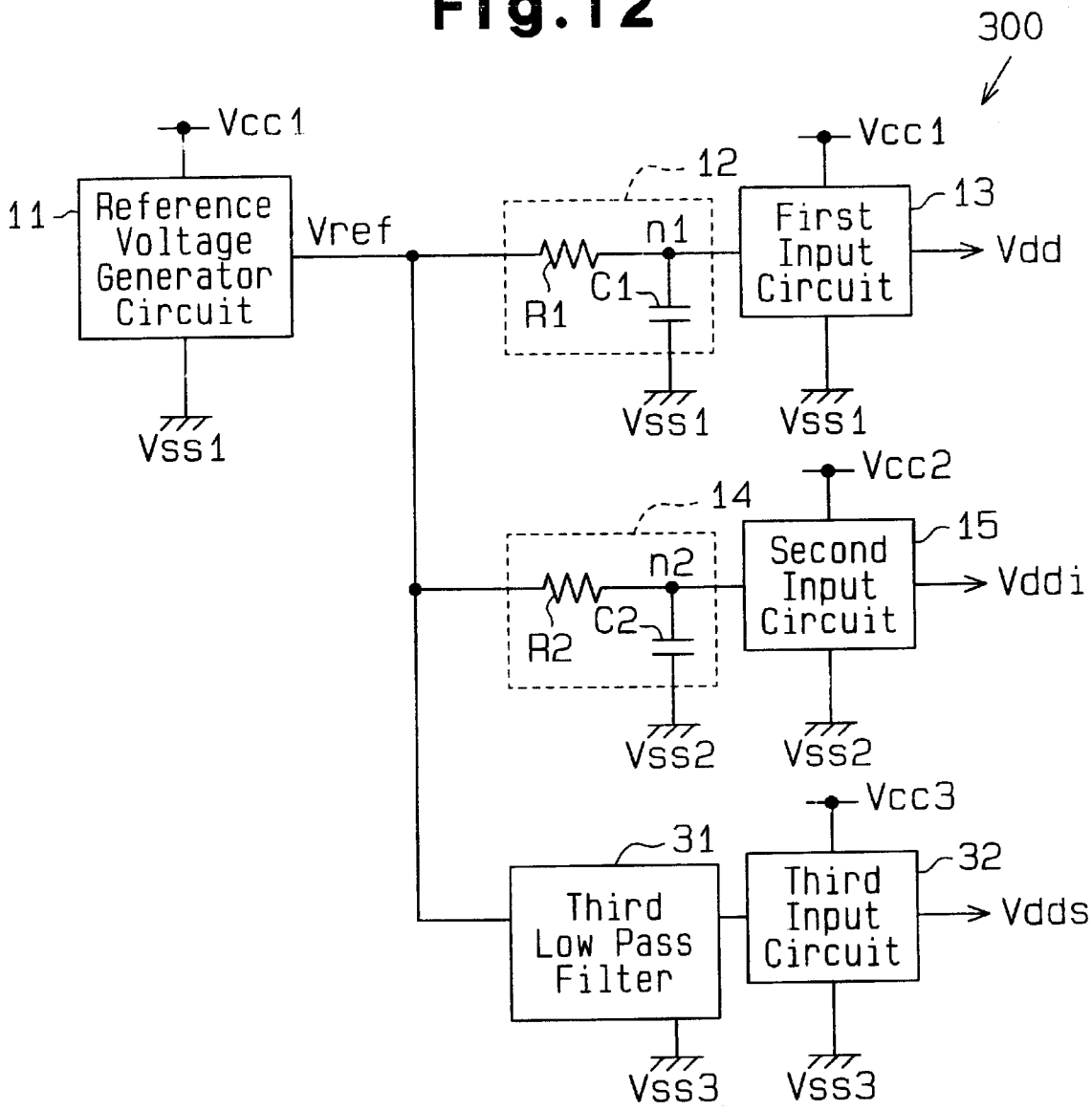
FIG. 12 is a schematic block diagram illustrating an exemplary modification to the semiconductor device of FIG. 6.

(d) As illustrated in FIG. 12, a third low pass filters 31 and a third input circuit 32 may be added. The third low pass filters 31 is connected to the reference potential generator circuit 11 and a low potential power supply Vss3 the system of which is different from that of the low potential power supplies Vss1, Vss2. The third input circuit 32 is connected to the third low pass filter 31 and receives power from a high potential power supply Vcc3 and the low power supply Vss3. In this case, the low potential power supplies Vss1, Vss2 and Vss3 are the same ground power supply.

(e) The first and second input circuits 13, 15 may include circuits other than the differential circuits.

(f) The resistors of the first and second low pass filters 12, 14 may be selected from diffusion resistors, polysilicon resistors and so on.

(g) The capacitors of the first and second low pass filters 12, 14 may be selected from MOS capacitors, metal capacitors and so on.

Therefore, the present examples and embodiments are to be considered as illustrative and not restrictive and the invention is not to be limited to the details given herein, but may be modified within the scope and equivalence of the appended claims.

What is claimed is:

1. A semiconductor device comprising:

a reference potential generator circuit for generating a reference potential in accordance with a first power supply;

a first filter connected to the reference potential generator circuit and the first power supply for filtering the reference potential to generate a first filtered reference potential;

a second filter connected to the reference potential generator circuit and a second power supply for filtering the reference potential to generate a second filtered reference potential;

a first input circuit connected to the first filter and the first power supply for receiving the first filtered reference potential to generate a first predetermined voltage; and a second input circuit connected to the second filter and the second power supply for receiving the second filtered reference potential to generate a second predetermined voltage.

2. The semiconductor device according to claim 1, wherein the first and second power supplies are laid out separately each other.

3. The semiconductor device according to claim 1, further comprising:

a first power supply wire connected to the reference potential generator circuit, the first filter and the first input circuit;

a first pad connected to the first power supply wire;

a second power supply wire connected to the second filter and the second input circuit; and a second pad connected to the second power supply wire.

4. The semiconductor device according to claim 1, further comprising:

a first wire for the first power supply connected to the reference potential generator circuit, the first filter and the first input circuit;

a second wire for the second power supply connected to the second filter and the second input circuit; and a pad connected to the first and second wires.

5. The semiconductor device according to claim 1, wherein the first and second power-supplies are the same ground power supply.

6. The semiconductor device according to claim 1, wherein the first filter includes:

a first resistor connected between the reference potential generator circuit and the first input circuit; and a first capacitor connected between the first power supply and a first node between the first resistor and the first input circuit, and the second filter includes:

a second resistor connected between the reference potential generator circuit and the second input circuit; and a second capacitor connected between the second power supply and a second node between the second resistor and the second input circuit.

7. The semiconductor device according to claim 1 further comprising:

a third filter connected to the reference potential generator circuit and a third power supply for filtering the reference potential to generate a third filtered reference potential;

a third input circuit connected to the third filter and the third power supply for receiving the third filtered reference potential to generate a third predetermined voltage.

8. The semiconductor device according to claim 7, wherein the first to third power supplies are laid out separately each other.

9. The semiconductor device according to claim 8, wherein the first to third power supplies are the same ground power supply.

* * * * *